US010814241B2

(12) United States Patent
Kapeter et al.

(10) Patent No.: US 10,814,241 B2
(45) Date of Patent: Oct. 27, 2020

(54) WEARABLE TOY SYSTEM

(71) Applicant: LEGO A/S, Billund (DK)

(72) Inventors: Luka Kapeter, Billund (DK); Jens Peter Haurum, Billund (DK); Nathalie Fernandez Alvarez, Odense M (DK); Steffen Gøtske, Vejle (DK)

(73) Assignee: LEGO A/S (DK)

( * ) Notice: Subject to any disclaimer, the term of this patent is extended or adjusted under 35 U.S.C. 154(b) by 0 days.

(21) Appl. No.: 16/492,291

(22) PCT Filed: Feb. 27, 2018

(86) PCT No.: PCT/EP2018/054776

§ 371 (c)(1),
(2) Date: Sep. 9, 2019

(87) PCT Pub. No.: WO2018/166784

PCT Pub. Date: Sep. 20, 2018

(65) Prior Publication Data

US 2020/0078698 A1 Mar. 12, 2020

(30) Foreign Application Priority Data

Mar. 14, 2017 (DK) ..... 2017 70178

(51) Int. Cl.
*A63H 33/06* (2006.01)
*A44C 9/00* (2006.01)

(52) U.S. Cl.
CPC ..... *A63H 33/06* (2013.01)

(58) Field of Classification Search
CPC ..... A44C 9/00; A44C 17/00; A44C 17/02; A44C 17/04; A44C 17/0208;
(Continued)

(56) References Cited

U.S. PATENT DOCUMENTS 4,309,879 A 1/1982 Gretz et al.
4,946,413 A 8/1990 Lehmann et al.
(Continued)

FOREIGN PATENT DOCUMENTS

CN 2930812 Y 8/2007
FR 2561938 A 10/1985
JP S58-165881 A 9/1983

OTHER PUBLICATIONS

International Search Report issued in international application No. PCT/EP2018/054776, dated Oct. 8, 2018.
(Continued)

*Primary Examiner* — Ken T Nguyen
(74) *Attorney, Agent, or Firm* — Day Pitney LLP

(57) ABSTRACT

A wearable toy system comprising a wearable component, a toy housing and at least one replaceable toy; wherein the wearable component comprises at least one fastening member for securing the wearable component to a part of a user's body; wherein the toy housing comprises a toy-receiving base and a cover, the toy-receiving base being adapted to receive at least a base member of the replaceable toy, the toy-receiving base and the cover together defining a void for accommodating at least a part of the replaceable toy when the base member is received by the toy-receiving base and when the cover is in a closed state; wherein the toy housing defines at least one opening when the cover is in the closed state, the opening allowing one or more parts of the replaceable toy to extend out of the toy housing.

20 Claims, 6 Drawing Sheets

(58) Field of Classification Search
CPC ..... A44C 9/0061; A63H 3/00; A63H 3/14; A63H 17/26; Y10T 29/23
USPC ..... 446/26–28; 63/1.14, 15, 15.8
See application file for complete search history.

(56) References Cited

U.S. PATENT DOCUMENTS

| | | | | |
|---|---|---|---|---|
| 5,375,434 | A * | 12/1994 | Wertheimer | A44C 17/0208 63/15 |
| 5,893,377 | A | 4/1999 | Chen | |
| 7,731,061 | B1 | 6/2010 | Woodhouse et al. | |
| 8,540,544 | B1 | 9/2013 | Logue | |
| 2003/0106136 | A1 | 6/2003 | Kahan | |
| 2011/0179823 | A1* | 7/2011 | Moody | A44C 9/00 63/4 |
| 2012/0103015 | A1 | 5/2012 | Graham et al. | |
| 2012/0113760 | A1 | 5/2012 | Pagrani | |
| 2013/0012097 | A1 | 1/2013 | Ohya et al. | |
| 2013/0263627 | A1* | 10/2013 | Bisserier | A44C 9/00 63/15 |
| 2015/0296935 | A1 | 10/2015 | Rana et al. | |
| 2016/0058138 | A1* | 3/2016 | Fukui | A44C 9/0053 63/15 |
| 2016/0120265 | A1 | 5/2016 | Cavaliere et al. | |

OTHER PUBLICATIONS

Written Opinion of the International Search Authority, issued in international application No. PCT/EP2018/054776, dated Oct. 8, 2018.

Search Report and Search Opinion issued in Danish priority application No. PA 2017 70178, dated Aug. 22, 2017.

* cited by examiner

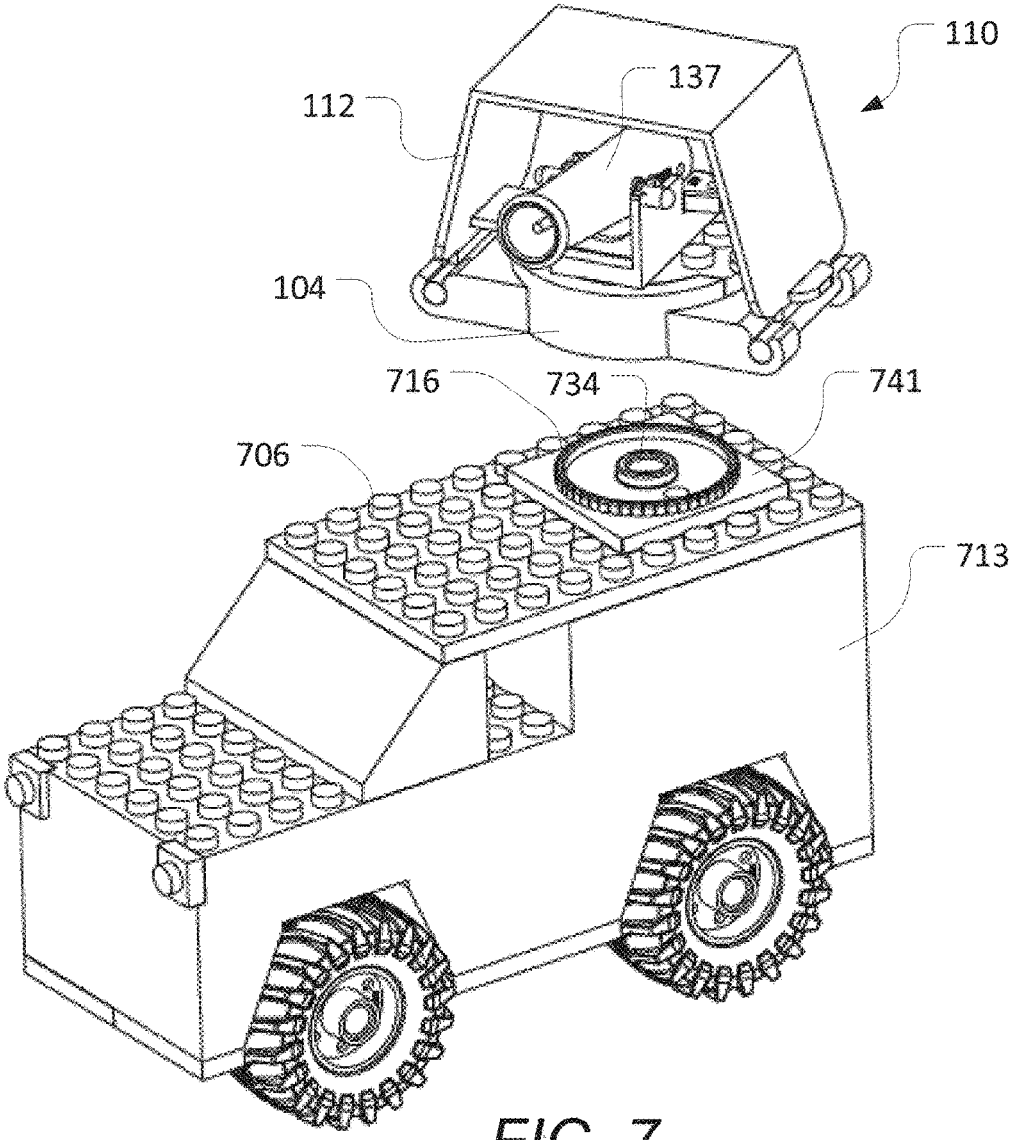
FIG. 7
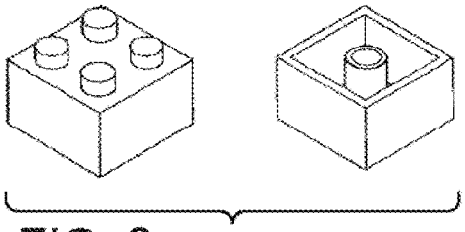
FIG. 8 - PRIOR ART
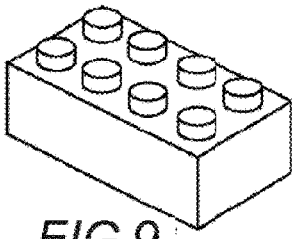
FIG.9
PRIOR ART
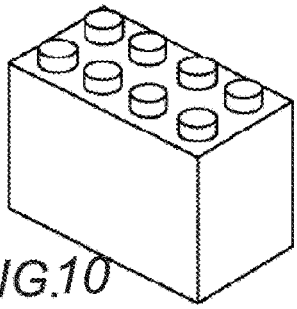
FIG.10
PRIOR ART

WEARABLE TOY SYSTEM

CROSS-REFERENCE TO RELATED APPLICATIONS

This application is a U.S. National Stage of International Application No. PCT/EP2018/054776, filed on 27 Feb. 2018 and published on 20 Sep. 2018, as WO 2018/166784 A2, which claims the benefit of priority to Danish Patent Application No. DK PA201770178, filed on 14 Mar. 2017. The content of each of the above referenced patent applications is incorporated herein by reference in its entirety for any purpose whatsoever.

The present invention relates to a wearable toy system.

BACKGROUND OF THE INVENTION

A variety of wearable toys are known in the art.

U.S. Pat. No. 7,731,061 discloses a wearable toy having an outer housing capable of rotating around a wearable component with more than one pod at the outer housing each able to receive a contained discharge element. This prior art toy is relatively bulky and provides only limited opportunities for user-configurability.

US 2012/113760 discloses a wrist watch having toys removably attached to the watch straps. However, it would be desirable to provide a wearable toy providing a higher degree of configurability and allowing for amusing, yet safe game play.

SUMMARY

In accordance with the various aspects disclosed herein, a wearable toy system comprises a wearable component, wherein the wearable component comprises at least one fastening member for securing the wearable component to a part of a user's body.

The fastening member may be a band, a strap an arcuate or ring-shaped member or another suitable fastening member operable for securing the wearable component to a part of the user's body. In some embodiments, the wearable component comprises two or more fastening members, e.g. two fastening members that extend from a mounting member, from a housing, or the like and that form a bifurcated pair of cooperating fastening members, e.g. a pair of straps, a pair of arcuate members or the like. In some embodiments the fastening members comprise cooperating fastening elements that are configured to interengage so as to secure the wearable component to the part of the user's body. Some embodiments of the wearable component may be configured to be worn around the user's wrist. In such an embodiment, the fastening members may comprise a wrist-band, a bracelet or the like.

In particular, according to a first aspect, the wearable toy system comprises the wearable component, a toy housing and at least one replaceable toy. The wearable component comprises the at least one fastening member for securing the wearable component to a part of a user's body. The housing comprises a toy-receiving base and a cover, the toy-receiving base being adapted to receive at least a base member of the replaceable toy, the toy-receiving base and the cover together defining a void for accommodating at least a part of the replaceable toy when the base member is received by the toy-receiving base and when the cover is in a closed state; wherein the toy housing defines at least one opening when the cover is in the closed state, the opening allowing one or more parts of the replaceable toy to extend out of the toy housing.

The cover provides a protective shield which may help preventing injuries that the replaceable toy could otherwise inflict on the user, e.g. when the user falls or otherwise inadvertently hits another part of the user's body, e.g. the user's eye, with the replaceable toy that extends away from the wearable component. Alternatively or additionally, the cover may also protect the replaceable toy from being damaged e.g. due to an inadvertent impact between the wearable toy and a hard surface. Nevertheless by providing one or more openings in the housing the user may interact with the replaceable toy without having to remove the cover.

The toy housing may be comprised in the wearable component, e.g. integrally formed with the wearable component. In some embodiments, the wearable component comprises a mounting member and the toy housing is connected to said mounting member of the wearable component, e.g. permanently or detachably connected to the mounting member. In some embodiments the toy housing may be rotatable relative to the mounting member.

In particular, in some embodiments, the wearable component comprises a mounting member defining a mounting face facing away from the part of the user's body when the wearable component is worn by the user; wherein the mounting member and the toy housing comprise respective mating mounting elements configured for removable attachment of the toy housing to the mounting face in rotatable engagement wherein the toy housing is rotatable around an axis of rotation projecting out of the mounting face.

Hence, different toy housings and, optionally, other accessories may selectively be attached to the wearable component and oriented in different orientations relative to the wearable component. In particular, the toy housing or other accessory is rotatable around an axis of rotation that projects out of the mounting face, i.e. an axis that projects out of the part of the user's body to which the wearable component is secured when the wearable component is worn by the user. Hence, the toy housing or other accessory may be arranged in different orientations relative to the part of the user's body on which the wearable component is worn, thereby increasing the configurability of the toy system. For example, when an accessory includes a display, the accessory may be rotated such that the display is more easily visible. Similarly, when the toy housing accommodates a projectile-emitting toy, the user may conveniently adjust the direction along which the projectiles are emitted relative to the user's body. Moreover, the wearable component may be kept relatively compact.

The mounting member may be a mounting plate defining a periphery, a bottom side and a top side. The bottom side faces the part of the user's body to which the wearable component is secured when the wearable component is worn by the user, while the top side is opposite the bottom side and defines the mounting face. The fastening members may extend from respective opposite sides of the periphery of the mounting plate radially outward relative to the mounting plate and relative to the axis of rotation; they may be configured to secure the wearable component to the user's wrist or to another part of the user's body with the bottom side of the mounting plate facing the user's body and the top side facing away from the user's body.

In some embodiments the toy housing or other accessory and the mounting member comprise cooperating indexing elements allowing the toy housing or other accessory to be rotated about said axis of rotation between a plurality of discrete orientations of the toy housing or other accessory relative to the mounting member, and to selectively retain the toy housing or other accessory in one or more of said discrete orientations. Accordingly, the user may rotate the toy housing or other accessory to bring it into one of a set of orientations where the toy housing or other accessory is retained.

The mounting member and the toy housing or other accessory may include cooperating mounting elements configured to interengage with each other, e.g. by a snap-fit engagement, such that they are rotatable relative to each other. In some embodiments, the mounting elements are annular or ring-shaped. The mounting elements may comprise cooperating pairs of indexing elements, e.g. a toothed annular surface and a protruding key member, respectively. The indexing elements may engage such that they retain the mounting elements in predetermined relative angular positions while allowing a user to rotate the mounting elements relative to each other between said angular positions, when the user applies a sufficiently high torque.

In some embodiments, the mounting element of the mounting member is configured to only interengage with the mounting element of selected accessories, e.g. including the toy housing or even only the toy housing, and not with the coupling members of other toy construction elements of the wearable toy system. Accordingly, the wearable toy system only allows the selected accessories to be attached to the wearable component and prevents the user from attaching an arbitrary toy model constructed from the toy construction elements to the wearable component, thus reducing the risk of inflicting injuries of damaging the toy models during play. In particular, in embodiments where the accessory comprises a toy housing that includes a toy-receiving base and a cover, the wearable toy system restricts the user to attaching toys to the wearable component that can be securely retained by the toy housing.

In some embodiments, the toy-receiving base defines a support face facing away from the part of the user's body when the wearable component is worn by the user and wherein the cover comprises a transverse portion extending across at least a part of the support face at a distance from the support face; wherein the opening is a lateral opening allowing one or more parts of the replaceable toy to extend out of the toy housing along a direction parallel to the support face. For example, the cover may comprise two side portions extending away from the support face, and a transverse portion extending between the side portions at a distance from the mounting face. The side portions may be side walls, legs, posts or the like. The lower ends of the side portions may be connected to the toy-receiving base, e.g. detachably connected such in a hinged or slidable engagement. The side portions may engage with the toy-receiving base at one, two, or more positions along a periphery of the toy-receiving base. In particular, the side portions may engage with the toy-receiving base only along a minor portion of the periphery, e.g. at two positions at opposite sides of the toy-receiving base, thereby still providing access between the exterior of the toy housing and the replaceable toy along a major part of the periphery of the toy-receiving base. The minor portion may be less than 50% of the length of the periphery, e.g. less than 40%, such as less than 30%. The cover may be bridge-shaped spanning across the toy-receiving base and providing lateral openings that provide access to the interior of the toy housing from opposite sides of the toy housing.

The cover prevents objects from extending out of the housing in the direction pointing away from the part of the user's body on which the wearable component is worn, thus protecting the replaceable toy from undesired impacts and providing protection of the user from being hit by parts of the replaceable toy that extend away from the part of the body to which the mounting member is secured. Nevertheless, the lateral opening allows the user to interact with the replaceable toy even when the cover is closed. For example, the opening may be sized such that a finger can extend through the opening into the toy housing. Alternatively or additionally, a part of the replaceable toy with which a user can interact may extend at least partially out of the opening; yet alternatively or additionally, an ejectable part of the replaceable toy may be ejected through the opening. When the opening is a lateral opening, any part of the toy extending or being ejected through the opening extends or is ejected at least predominantly in a direction parallel to the support face defined by the toy-receiving base, thus reducing the risk of injuries. Generally, the cover may limit the height of the replaceable toy along a direction away from the toy-receiving base and, in particular, along a direction normal to the support face defined by the toy-receiving base. When the housing is rotatable around an axis of rotation relative to a mounting member of the wearable component, as described herein, the cover may prevent parts of the toy from projecting away from the mounting member along the direction of the axis of rotation, while the lateral opening may allow a part of the toy to extend out of the housing along a radial direction relative to said axis of rotation. Accordingly, the support face may define a first direction projecting out of the support face, normal to the support face at least at a center location of the support face, and the opening may allow an object to extend into or out of the toy housing along a radial direction across, e.g. normal to, the first direction, while the cover prevents an object from extending into or out of the toy housing along the first direction.

Generally, the cover can selectively be in an open state and in a closed state. In some embodiments, the cover may be attached and detached, e.g. by a suitable snap-fit coupling, in order to close and open the cover, respectively. Additionally or alternatively, the cover may be hinged or slideable or otherwise movable between a closed and an open position while remaining connected to the toy-receiving base. The cover may be made of transparent material, e.g. transparent plastic, such that the replaceable toy accommodated in the housing is visible from outside the toy housing even when the cover is closed. In some embodiments, the cover may include one or more additional functions, e.g. a red-reveal function or a mechanical function. For example, the cover may comprise an actuator member operable to be actuated by a user when the cover is in its closed state and operable to engage an actuator of a toy retained in the housing so as to actuate a function of the toy. For example, the actuator member may be a push button extending through the cover such that the bush button can be pressed by the user and pushed against an actuator of a toy positioned in the housing.

In some embodiments, the cover comprises at least one retaining member adapted to engage the replaceable toy when replaceable toy is received by the toy-receiving base and when the cover is in its closed state so as to retain the replaceable toy in engagement with the toy-receiving base. In particular, in some embodiments, the cover comprises at least one retaining member adapted to engage the base member of the replaceable toy when the base member is received by the toy-receiving base and when the cover is in its closed state so as to retain the base member in engagement with the toy-receiving base. In particular, the retaining member may be adapted to engage the base member of the replaceable toy only when the cover is in its closed state so as to retain the base member in engagement with the toy-receiving base only when the cover is in its closed state. For example, the toy-receiving base itself may be configured to receive but not to retain the base member, i.e. to receive the base member only in a loosely fitting engagement, i.e. such that the base member is only retained in the toy receiving base when held in place by the cover when the cover is in its closed state. Accordingly, the user may be prevented from fixedly attaching the replaceable toy to the wearable component without closing the protective cover. The retaining member may e.g. be in the form of a locking member that is brought into engagement with the base member when the cover is closed, e.g. in an interlocking engagement, so as to lock the base member to the toy-receiving base. In some embodiments, the at least one retaining member engages the base member only along a minor portion of the periphery of the base member, e.g. at two positions at opposite sides of the base member, thereby still providing access between the exterior of the toy housing and the replaceable toy along a major part of the periphery of the base member. The minor portion may be less than 50% of the length of the periphery, e.g. less than 40%, such as less than 30%, such as less than 20%.

In some embodiments, the base member and the toy-receiving base comprise respective cooperating indexing elements adapted to allow the base member to be received by the toy-receiving base only in one of a set of one or more discrete relative orientations of the base member relative to the toy-receiving base. The indexing elements may be configured such that one or more protruding part and/or ejectable part of the replaceable toy is aligned with said opening when the replaceable toy is received by the toy-receiving base in at least one of the one or more discrete relative orientations. The indexing elements may comprise one or more protrusions, e.g. teeth, and corresponding recesses. In some embodiments, the base member is formed as a base plate having one or more radially extending protrusions and the toy-receiving base comprises a receptacle whose periphery comprises one or more radial slots for receiving the protrusions. In some embodiments, the cover comprises retaining members as described herein, where the retaining members are configured to engage with one or more indexing elements of the base member so as to retain the base member in engagement with the toy-receiving base when the cover is in its closed state and when the base member is received by the toy-receiving base in one of said discrete relative orientations. The relative orientations may be defined as relative angular positions of the base member relative to the toy-receiving base, e.g. as angular positions in a plane parallel to the mounting face. The angular position may be defined as relative angular positions of a reference axis of the base member relative to a reference axis of the mounting face.

In some embodiments, the replaceable toy comprises a user-operable activator, e.g. a push button, a lever, or another type of actuator. The replaceable toy may be operable to perform a user-activatable function responsive to an activation of the user-operable activator, and the user-operatable activator may extend out of the housing through the opening or may be activatable through the opening. Hence, the opening may be shaped and sized such the activator can be activated even when the cover is closed. The function may be selected from a variety of possible functions, including e.g. mechanical and/or electrical functions. Examples of a mechanical function include movements/motion such as by driving a rotating output shaft, winding-up a string or a chain which enables pulling an object closer to the replaceable toy, ejecting an object, etc. For example, the replaceable toy may comprise a toy body and an ejectable component operable to be ejected by the toy body through the opening when the replaceable toy is positioned inside the toy housing. The function may be powered by the activation of the actuator and/or by another power source, e.g. an internal power source of the replaceable toy, e.g. a battery, a loaded spring, or the like. Examples of an electrical function, emitting visible light, emitting constant or blinking light, activating several lamps in a predetermined sequence, emitting an invisible light signal, emitting audible sound such as beep, alarm, bell, siren, voice message, music, synthetic sound, natural or imitated sound simulating and stimulating play activities, recording and playback of a sound, emitting inaudible sound such as ultrasound, emitting a radio frequency signal or an infrared signal to be received by another component, etc. or combinations of the above.

The present disclosure relates to different aspects including the wearable toy system described above and in the following, corresponding apparatus, systems, methods, and/or products, each yielding one or more of the benefits and advantages described in connection with one or more of the other aspects, and each having one or more embodiments corresponding to the embodiments described in connection with one or more of the other aspects and/or disclosed in the appended claims.

According to a second aspect, the wearable toy system comprises the wearable component, a plurality of toy construction elements, a toy-receiving base and at least one replaceable base member. The wearable component comprises at least one fastening member for securing the wearable component to a part of a user's body, e.g. as described in connection with one or more of the other aspects disclosed herein.

The toy-receiving base may be comprised in the wearable component, e.g. integrally formed with the wearable component. In some embodiments, the wearable component comprises a mounting member and the toy-receiving base is connected to said mounting member of the wearable component, e.g. permanently or detachably connected to the mounting member. In some embodiments the toy-receiving base may be rotatable relative to the mounting member as described herein. In some embodiments the toy-receiving base may be part of a toy housing as described herein.

The toy-receiving base defines a support face facing away from the part of the user's body when the wearable component is worn by the user, and the toy-receiving base is adapted to receive the base member. Each of the toy construction elements comprises coupling members for detachably connecting the toy construction elements with other toy construction elements of the toy system. The base member defines a top side and a bottom side, opposite the top side and adapted to face the support face of the toy-receiving base when the base member is received by the toy-receiving base, wherein the top side comprises one or more coupling members adapted to interengage with corresponding mating coupling members of one or more of said toy construction elements.

Accordingly, the wearable toy system is a toy construction system that allows a user to construct different replaceable toys to be inserted into the toy housing of the wearable component. To this end, the base member forms an interface between the wearable component and a toy model constructed from the toy construction elements, i.e. an interface for attaching toy construction elements that allows the constructed toy to be secured to the wearable component.

The toy-receiving base may be a part of a toy housing as described herein, where the toy housing comprises the toy-receiving base and a cover. Hence, the toy housing limits the size and shape of the replaceable toy that can be attached to the wearable component, thereby preventing the user from constructing toys that may be harmful or cause injuries. When the cover comprises a retaining member as described herein, the replaceable toy constructed by the user can only be fixedly attached to the wearable component when it can be accommodated by the toy housing, in particular along a direction away from the support face of the toy-receiving base.

The coupling members may be based on a frictional engagement of corresponding coupling members of two toy construction elements; other examples of coupling members may be based on another type of coupling mechanism, e.g. an interlocking mechanism. In one particular example, the coupling members comprise protrusions and cavities such that one or more protrusions of one toy construction element engage in frictional engagement with one or more cavities of another toy construction element. It will be appreciated that a toy construction system may comprise different types of coupling members. Typically, the construction members are configured such that they can only engage other construction members that are compatible with the toy construction system. The coupling members may further impose a set of restrictions as to how construction elements can be interconnected with each other, e.g. only at a predetermined set of relative positions and/or orientations. Coupling members may thus be compatible with the toy construction system only if they adhere to the restrictions imposed by the toy construction system, e.g. as regards the type, shape, size, position and orientation of the individual coupling members. In some embodiments, at least some of the coupling members are adapted to define a direction of connection and to allow interconnection of each construction element with another construction element in a discrete number of predetermined relative orientations relative to the construction element. Consequently, a large variety of possible building options are available while ensuring interconnectivity of the building elements. The coupling members may be positioned on grid points of a regular grid, and the dimensions of the toy construction elements may be defined as integer multiples of a unit length defined by the regular grid. It will be understood that a grid may be defined by a single unit length, by two unit lengths, e.g. one unit length applicable in two spatial dimensions while the other unit length is applicable in the third spatial dimension. Yet alternatively, a three-dimensional grid may define three unit lengths, one for each spatial dimension.

In some embodiments, and as already described above, the base member and the toy-receiving base comprise respective indexing elements adapted to allow the base member to be received by the toy-receiving base only in one of a set of one or more discrete relative orientations of the base member relative to the toy-receiving base. In particular, in some embodiments, the coupling members of the base member are arranged in a two-dimensional grid on the top side of the base member, the two-dimensional grid defining a first and a second principle direction, and wherein at least one of the principle directions projects outward through said opening of the toy housing when the base member is received by the toy-receiving base. Hence, the toy system facilitates construction of user-designed replaceable toys that are compatible with the wearable component, i.e. which easily fit into the toy housing while accommodating elements that laterally protrude out of the housing, or that comprise ejectable parts or parts that should be accessible with the cover closed According to a third aspect, the wearable toy system comprises the wearable component and a replaceable accessory. The wearable component comprises a mounting member which defines a mounting face facing away from the part of the user's body to which the wearable component is secured when the wearable component is worn by the user. The mounting member and the accessory comprise respective mating mounting elements configured for removable attachment of the accessory to the mounting face in rotatable engagement wherein the accessory is rotatable around an axis of rotation projecting out of the mounting face.

Hence, different accessories may selectively be attached to the wearable component and oriented in different orientations relative to the wearable component. In particular, the accessory is rotatable around an axis of rotation that projects out of the mounting face, i.e. an axis that projects out of the part of the user's body to which the wearable component is secured when the wearable component is worn by the user. Hence, the accessory may be arranged in different orientations relative to the part of the user's body on which the wearable component is worn, thereby increasing the configurability of the toy system. For example, when the accessory includes a display, the accessory may be rotated such that the display is more easily visible. Similarly, when the accessory is a projectile-emitting toy, the user may conveniently adjust the direction along which the projectiles are emitted relative to the user's body. Moreover, the wearable component may be kept relatively compact.

The mounting member may be a mounting plate defining a periphery, a bottom side and a top side. The bottom side faces the part of the user's body to which the wearable component is secured when the wearable component is worn by the user, while the top side is opposite the bottom side and defines the mounting face. The fastening members may extend from respective opposite sides of the periphery of the mounting plate radially outward relative to the mounting plate and relative to the axis of rotation; they may be configured to secure the wearable component to the user's wrist or to another part of the user's body with the bottom side of the mounting plate facing the user's body and the top side facing away from the user's body.

In some embodiments the accessory and the mounting member comprise cooperating indexing elements allowing the accessory to be rotated about said axis of rotation between a plurality of discrete orientations of the accessory relative to the mounting member, and to selectively retain the accessory in one or more of said discrete orientations. Accordingly, the user may rotate the accessory to bring it into one of a set of orientations where the accessory is retained.

The mounting member and the accessory may include cooperating mounting elements configured to interengage with each other, e.g. by a snap-fit engagement, such that they are rotatable relative to each other. In some embodiments, the mounting elements are annular or ring-shaped. The mounting elements may comprise cooperating pairs of indexing elements, e.g. a toothed annular surface and a protruding key member, respectively. The indexing elements may engage such that they retain the mounting elements in predetermined relative angular positions while allowing a user to rotate the mounting elements relative to each other between said angular positions, when the user applies a sufficiently high torque.

The accessory may be a replaceable toy and the wearable toy system may comprise the wearable component and a plurality of different replaceable toys that can each be selectively attached to the wearable component e.g. such that only one toy at a time may be attached to the wearable component. Each toy may provide a mechanical or electronic play function. For example, a mechanical play function may comprise a movement of a part of the toy, ejection of a projectile, or the like. An electronic function may include a visual or audible effect, e.g. the emission of sound and/or light, the display of information on a display, and/or the like. In some embodiments, the accessory may comprise a toy housing for accommodating respective replaceable toys as will be described in greater detail below.

In some embodiments, the wearable toy system comprises a plurality of toy construction elements, each of the toy construction elements comprising coupling members for detachably connecting the toy construction element with other toy construction elements of the wearable toy system. The accessory comprises a mounting element operable to interengage with the mounting element of the mounting member for attachment of the accessory to the mounting member in rotatable engagement, as described above. The mounting element of the accessory may further be configured to interengage with one or more of the coupling members of one or more of the toy construction elements so as allow attachment of the accessory to said one or more toy construction elements of the wearable toy system. Hence, the accessory may, in addition to be connectable to the wearable component, be used as a construction element of a toy construction system and be incorporated into a toy model constructed from the toy construction elements.

In some embodiments, the mounting element of the mounting member is configured to only interengage with the mounting element of the accessory and not with the coupling members of the other toy construction elements of the wearable toy system. Accordingly, the wearable toy system only allows the accessory to be attached to the wearable component and prevents the user from attaching an arbitrary toy model constructed from the toy construction elements to the wearable component, thus reducing the risk of inflicting injuries of damaging the toy models during play. In particular, in embodiments where the accessory comprises a toy housing that includes a toy-receiving base and a cover, the wearable toy system restricts the user to attaching toys to the wearable component that can be securely retained by the toy housing. Embodiments of the toy housing will be described in more detail below.

Additional features and advantages will be made apparent from the following detailed description of embodiments that proceeds with reference to the accompanying drawings.

BRIEF DESCRIPTION OF THE DRAWINGS

Preferred embodiments of the invention will be described in more detail in connection with the appended drawings, where

FIG. 7 illustrates attachment of an accessory of the wearable toy system of FIGS. 1-3 to a toy construction model.

FIGS. 8-10 each show a prior art toy construction element.

DETAILED DESCRIPTION

Figure 1:
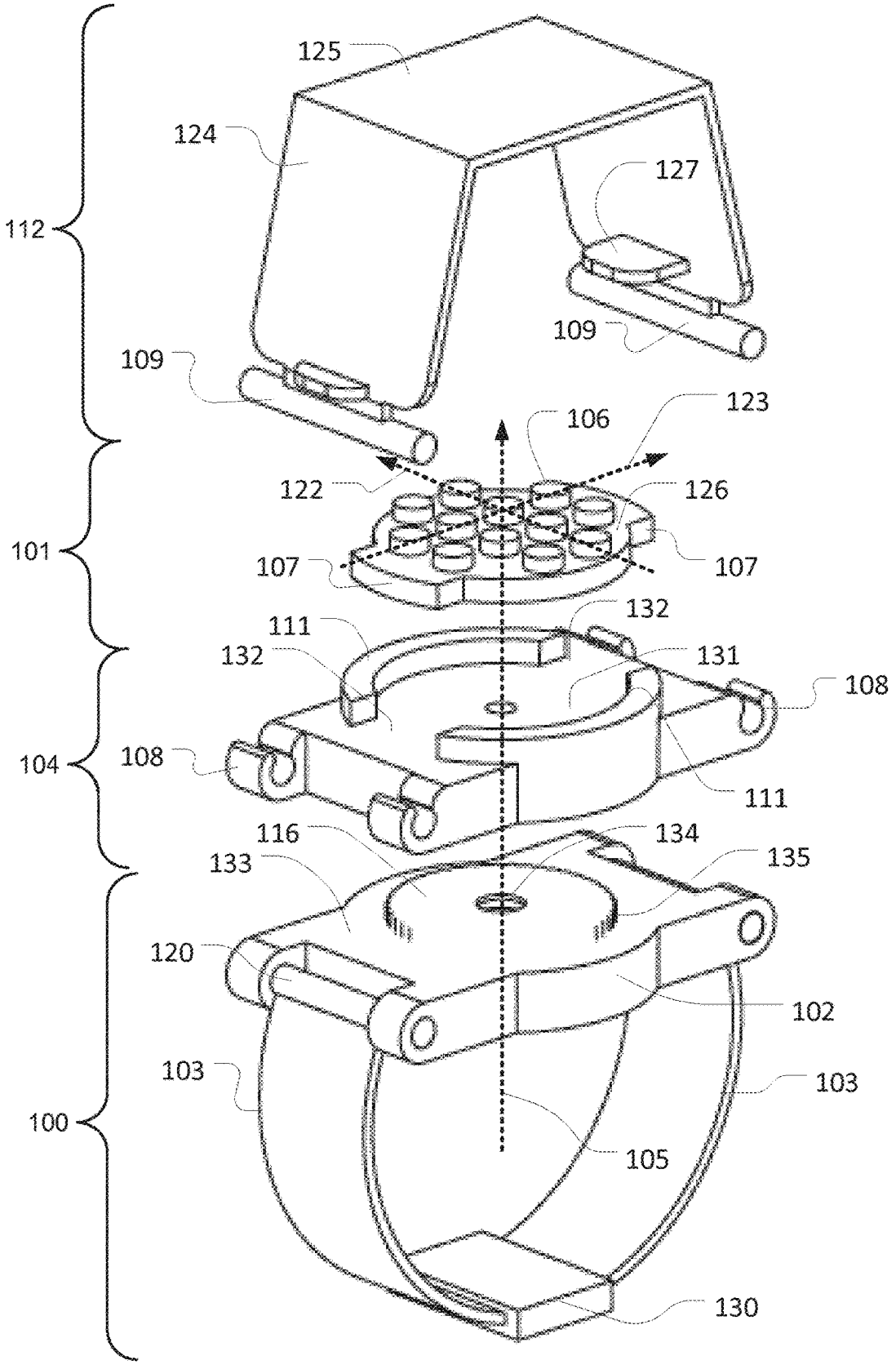
FIG. 1 illustrates a partially exploded view of an embodiment of a wearable toy system.

FIGS. 1, 2A-B and 3A-C illustrate an embodiment of a wearable toy system. The toy system comprises a wearable component, generally designated 100, a housing and a base plate 101. The wearable component comprises a mounting member in the form of a mounting plate 102. The wearable component further comprises fastening members, in this example two straps 103 that extend from opposite edges of the mounting plate and that together form a wrist band such that the wearable component can be worn around a user's wrist like a watch, e.g. with a bottom face of the mounting plate resting against the back of the wrist, i.e. against the side of the wrist extending from the back of the user's hand.

The mounting plate 102 comprises a bottom face operable to face the part of the user's body on which the wearable component is worn, and a mounting face 133, opposite the bottom face and facing away from the part of the user's body on which the wearable component is worn. The mounting plate 102 is configured for detachable attachment of the toy housing to the mounting plate, as will be described below.

The toy housing comprises a toy-receiving base 104 and a cover 112 that together form the toy housing. The toy-receiving base 104 is formed as a plate having a bottom side that is configured to face the mounting face 133 of the mounting plate when the toy housing is attached to the mounting plate. The toy-receiving base comprises a recess 131 into which the base plate 101 can be removably inserted. The recess is formed in a top face of the toy-receiving base, opposite the bottom face. The bottom of the recess defines a support face for the base plate 101. The base plate 101 comprises a disc-shaped central portion 126 and radial teeth 107 that extend radially outward from the outer edge of the disc-shaped central portion. The teeth 107 are distributed along the periphery of the disc-shaped central portion. In this particular example, the base plate comprises two such teeth located at opposite positions of the periphery of the disc-shaped central portion. In other embodiments, the base plate may comprise a single indexing element 135 or more than two indexing elements 135 which may be arranged equidistantly around the periphery of the disc-shaped central portion. The recess 131 of the toy-receiving base 104 is shaped such that the base plate 101 can be received by the recess 131. In particular, the recess comprises a side walls in that include slots 132 for receiving the teeth of the base plate, such that the base plate can be received by the recess in discrete orientations (in this embodiment two distinct orientations) and such that the teeth prevent the base plate from rotation relative to the toy-receiving base when the base plate is received in the recess. When the base plate 101 is received in the recess 131, a bottom side of the base plate faces the toy-receiving base and a top side of the base plate faces away from the toy-receiving base.

The base plate 101 comprises a number of coupling members 106 arranged on the top side of base plate, in this example on the top side of the disc-shaped central portion of the base plate. The coupling members are formed as protrusions that are configured to frictionally engage mating cavities of toy construction elements of a toy construction system. The coupling members are arranged in a regular 2D grid defined by principle directions 122 and 123. The teeth 107 are positioned on opposite sides of the disc-shaped central portion aligned with one of the principle directions. In other embodiments, the teeth may be aligned with respective ones of the principle directions.

The toy-receiving base 104 comprises hinges 108 positioned at the outer edge of the toy-receiving base on opposite sides of the recess. The hinges are aligned with the pair of slots 132 for receiving the teeth 107 of the base plate. Hence, when the base plate 101 is positioned in the recess 131 of the toy-receiving base 104, the hinges 108 are aligned with one of the principle directions 122, 123 of the grid that is defined by the coupling members 106.

The cover 112 comprises two side walls 124 and a transverse portion 125 extending between respective upper ends of the side walls 124. The lower ends of the side walls, opposite the upper ends, comprise rod-shaped hinge parts 109 that are configured to snap fit into the hinges 108 of the toy-receiving portion. Hence, when the rod-shaped hinge parts 109 are both pressed into the respective hinges 108, the side walls 124 extend upwards, relative to the top side of the toy-receiving base 104, on opposite sides of the recess 131 for receiving the base plate 101. The transverse portion 125 thus spans across the recess 131 at a height above the recess as defined by the height of the side walls 124. The transverse portion 125 is shaped and sized such that it extends across at least the disc-shaped central portion 126 of the base plate when the base plate is inserted in the recess 131, i.e. across the portion of the base plate that comprises the coupling members 106. When the cover 112 is closed, the cover and the toy-receiving base 104 define a space between the transverse portion 125 and the toy-receiving base 104. Access to the space along the direction 105 projecting out of the support face of the toy-receiving base 104 is blocked by the toy-receiving base 104 and by the transverse portion 125 of the cover. Along the direction 123, access to the space is blocked by the side walls 124 of the cover. However, the cover and the toy-receiving base define lateral openings that allow access to the space along the direction 122, i.e. along one of the principal directions defined by the grid of coupling members 106 of the base plate.

Figure 2A:
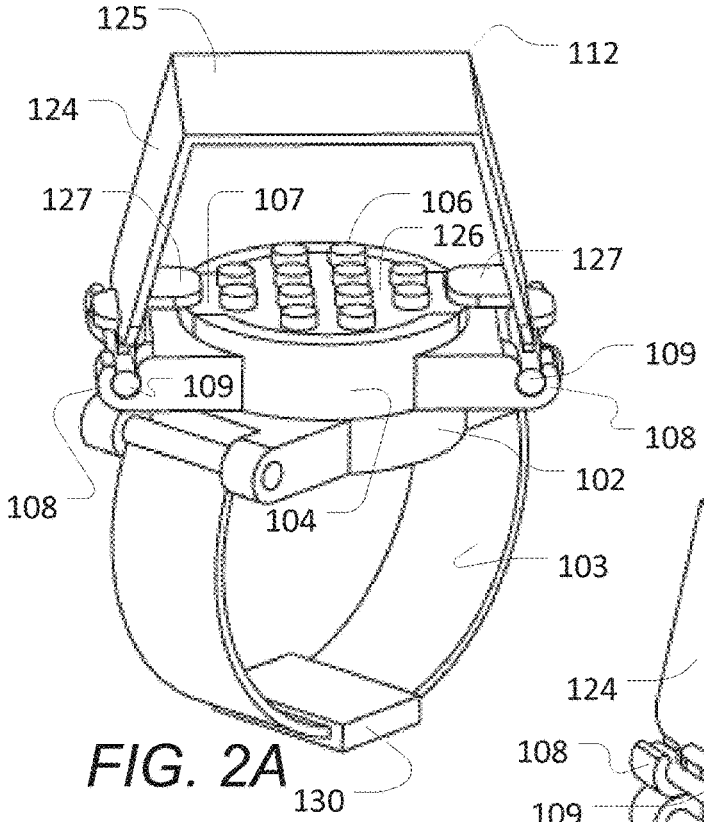
FIGS. 2A-C illustrate the wearable toy system of FIG. 1 in different states.
Figure 2B:
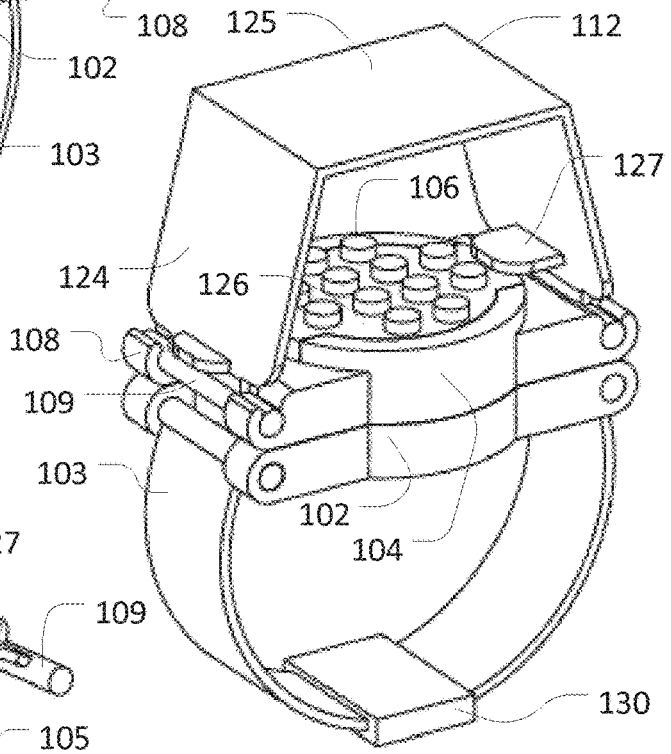
Figure 2C:
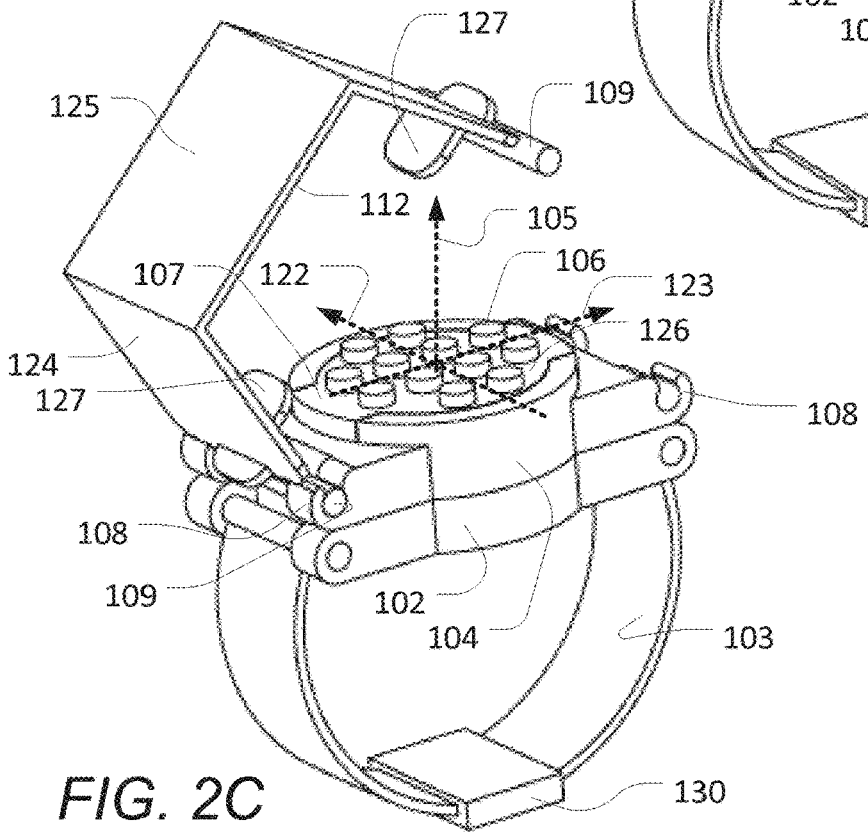

The cover 112 can be detached from the toy-receiving base 104 by detaching both side walls 124 from the hinges 108. Alternatively, when the cover is only attached to one of the hinges 108, the cover may be pivoted between an open and a closed position and secured in the closed position by snapping the other sidewall into the other hinge 108. FIG. 2C illustrates the cover 112 attached to one of the hinges 108 of the toy-receiving base 104 and pivoted open while FIGS. 2A-B illustrate the over in its closed state. The cover comprises retaining member 127 that extend inwards from the side walls 124, i.e. they project into the space defined between the cover 112 and the support face 132 of the toy-receiving base. The retaining members are configured to abut the teeth 107 of the base plate that are aligned with the hinges 108 when the cover is closed, i.e. when both hinge elements 109 engage the respective hinges 108. Hence, when the cover 112 is closed, the retaining members 127 lock the base plate 101 in position inside the recess 131 of the toy-receiving base. When one or both side walls are disengaged from the corresponding hinges 108, i.e. when the cover 112 is either pivoted open or detached entirely, the retaining members 127 no longer engage the teeth 107 of the base plate and the base plate 101 is free to slide out of the recess 131.

Figure 3A:
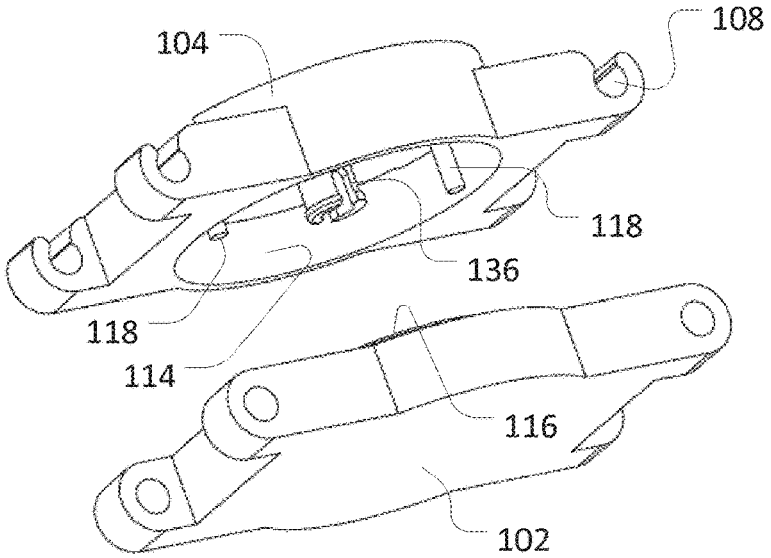
FIGS. 3A-C illustrate the attachment of an accessory to the wearable component of the wearable toy system of FIG. 1.
Figure 3B:
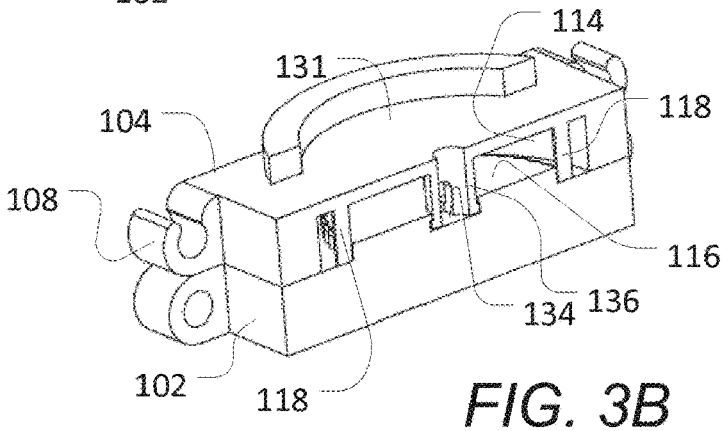
Figure 3C:
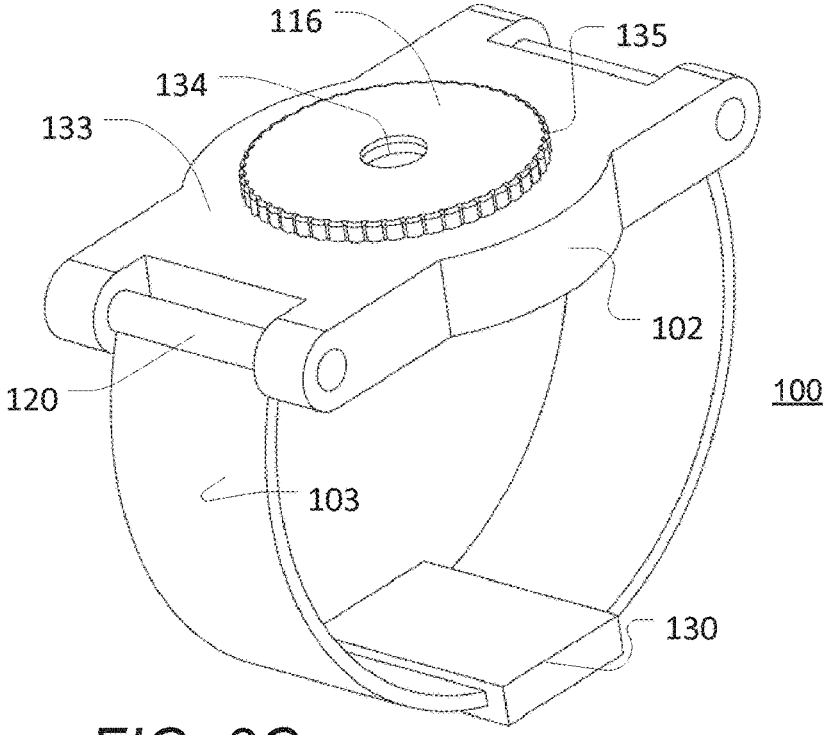

The toy-receiving base 104 is rotatably attached to the mounting plate 102 such that the toy-receiving base is rotatable about the axis 105 that extends out of the mounting plate, i.e. an axis projecting out of the back of the user's wrist when the wearable component is worn around the user's wrist. FIGS. 2A and 2B illustrate the toy-receiving base in two different angular positions. In particular, the toy-receiving base may be rotated between a number of predetermined angular positions, e.g. angular positions at predetermined intervals, e.g. at 1° intervals or other suitable intervals. To this end, the mounting plate 102 comprises a mounting element in the form of a circular elevated portion 116 comprising a central hole 134, and the toy-receiving base 104 comprises corresponding mounting elements (as can best be seen in FIG. 4A) in the form of an annular link member 136 that is configured to be inserted into the hole 134 in a snap-fit, rotatable engagement, a downwardly extending skirt 114 operable to surround the elevated portion 116 and downwardly extending resilient pins 118 operable to engage with the outer edge 115 of the elevated portion 116. The edge 115 of the elevated portion 116 comprises radial recesses that cooperate with the resilient pins 118 to provide a number of rest positions at respective angular positions where the toy-receiving member is retained. However, when the user applies a torque to the toy-receiving base relative to the mounting plate, the toy-receiving base is rotatable between the rest positions. In particular, FIG. 3A shows the mounting plate 102 and the toy-receiving base 104 detached from each other; FIG. 3B shows partial sections of the mounting plate 102 and the toy-receiving base 194 attached to each other; FIG. 3C shows the wearable component 100.

The straps 103 are hingedly attached to the mounting plate 102, e.g. by hinges 120. In some embodiments, the straps 103 are attached to the mounting plate 102 via a number of extension elements that can be hingedly connected to each other, to the mounting plate and/or to the straps, respectively. Hence, by inserting one or more of extension elements, the wearable component may be adapted to different wrist sizes.

The straps 103 can be connected with each other via a suitable 130 or other suitable fastener. In some embodiments, the straps may be connected with each other by a rack-and-pinion adjusting device or by other fastening members and/or another form of tightening mechanism.

Figure 4A:
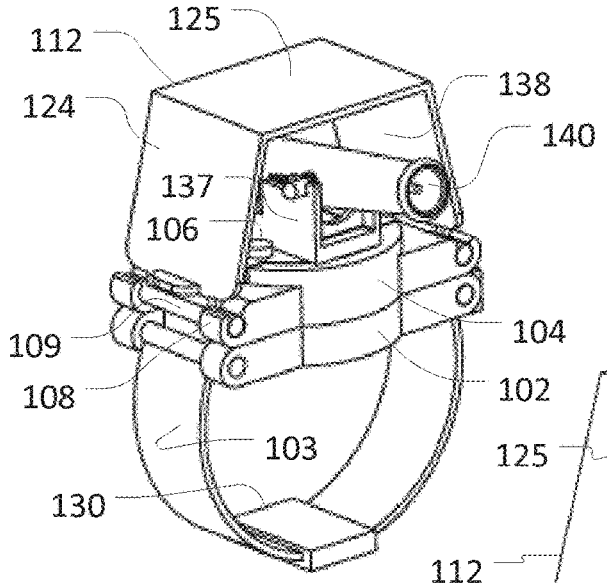
FIGS. 4A-D illustrate the wearable toy system of FIGS. 1-3 having inserted therein respective examples of replaceable toys.
Figure 4B:
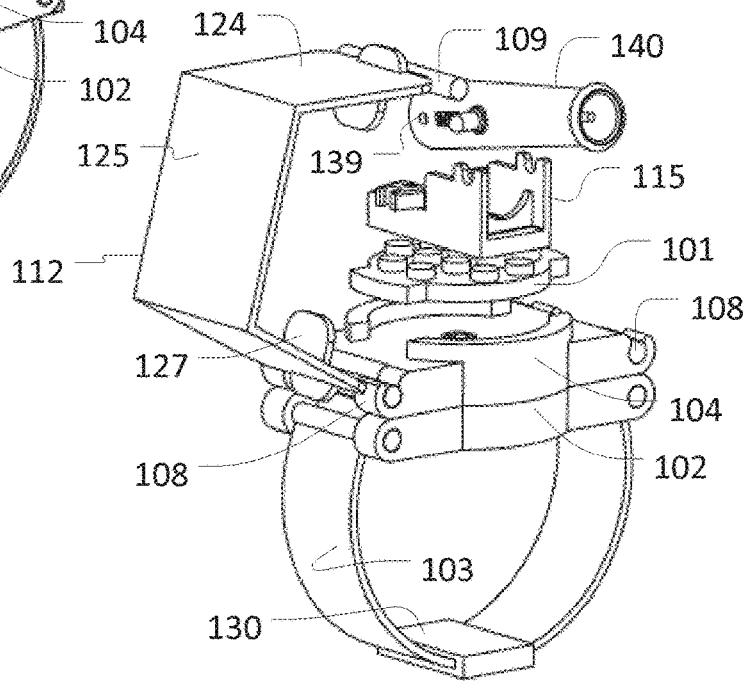

FIGS. 4A-D illustrate the wearable toy system of FIGS. 1-3 with different replaceable toys inserted into the toy housing. To this end, the base plate 101 may be removed from the recess and a user may construct a toy from toy construction elements of a toy construction system compatible with the coupling members 106 on the top face of the base plate and attach the constructed toy to the base plate 101. For example, FIG. 4B shows the base plate 101 removed from the recess and two toy constructions elements 140 and 115 that may be connected to each other to form a toy construction model, in this case a toy canon. The user may then place the constructed toy with the base plate attached to it on the toy-receiving base 104 such that the base plate is loosely received in the recess 131. For example, FIG. 4A shows the constructed toy 137 attached to the base plate and inserted into the toy housing.

When the user closes the cover 112, as illustrated in FIGS. 4A, C and D, the teeth 127 of the cover engage the corresponding teeth 107 of the base plate so as to lock the base plate, and thus the replaceable toy, in position. As can be seen in FIGS. 4A, C and D, the cover 112 limits the height of a toy that can be inserted and secured in the housing. However, parts of the toy may laterally extend through lateral openings 138 in the housing. In the example of FIG. 4A, the replaceable toy comprises a spring-powered launching pod 140 for an arrow-like projectile (not shown). The spring of the launching pod is energised by pushing the projectile into a tubular opening of the launching pod. The projectile can be released and ejected by actuating a button 139. The button 139 extends out of one of the lateral openings 138 of the housing thus allowing a user to reach and actuate the button even with the cover 112 being closed. Similarly, the projectile can be ejected through the opposite lateral opening of the housing.

Figure 4C:
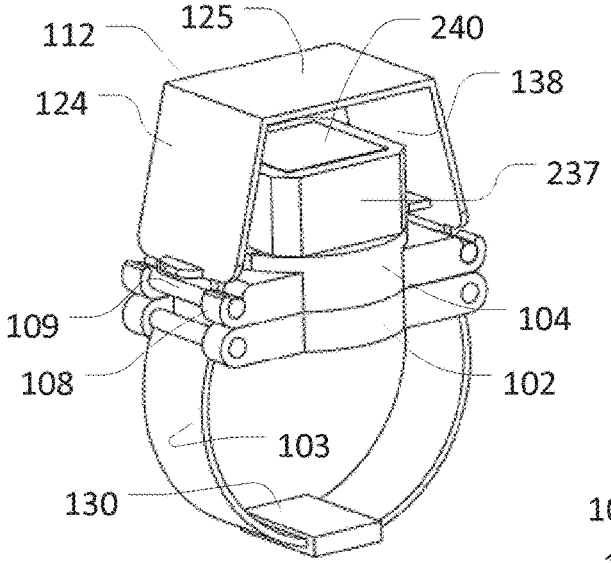
Figure 4D:
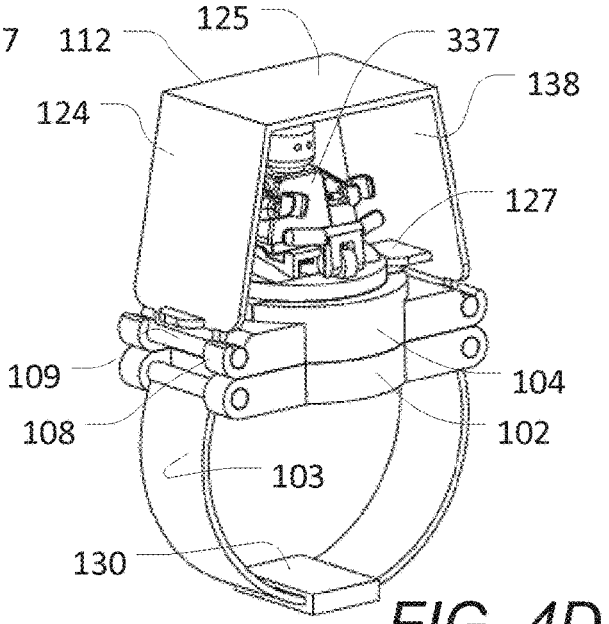

FIGS. 4C-D illustrate further examples of replaceable toys, designated 237 and 337, respectively. As can be seen from FIGS. 4A-D, the user may construct different types of toys, e.g. for launching different types of projectiles or for performing other functions. The toys can be attached to the base plate 101 and inserted and fixated into the housing of the wearable component as described in connection with FIGS. 4A-C. FIG. 4C shows the wearable toy system having an electronic toy element 237 inserted into the housing. The electronic toy element 240 comprises a display 240 that is visible through the transparent cover 112. In some embodiments, the display may be a touch screen and the user may reach into the housing through one of the lateral openings 138 so as to interact with the touch screen (or with another interface or actuator of a toy).

Figure 5B:
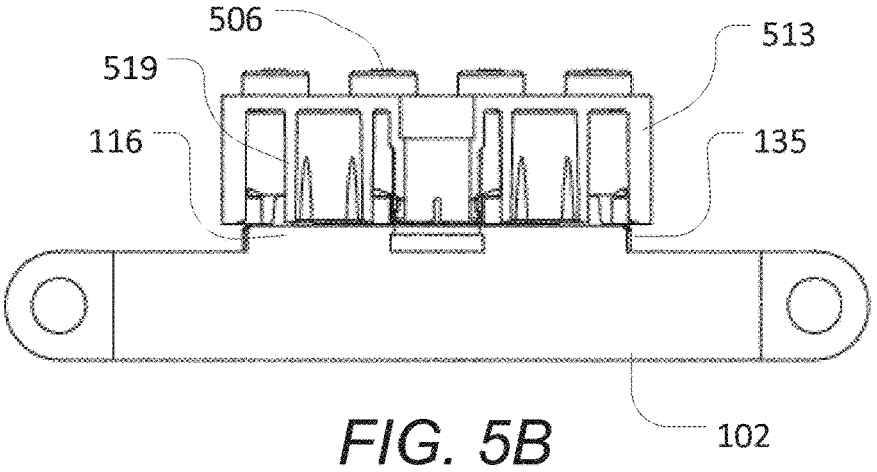
FIGS. 5A-B illustrate the selective attachment of an accessory to the wearable component of the wearable toy system of FIGS. 1-3.
Figure 5A:
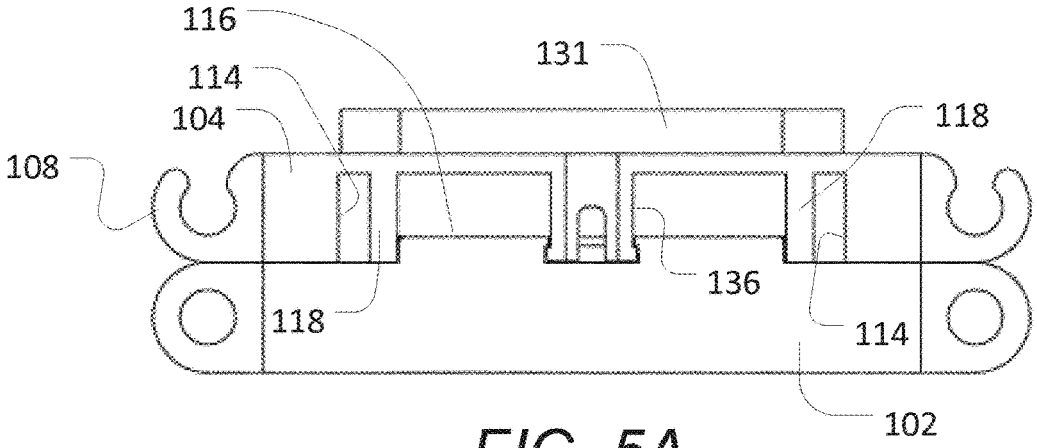
Figure 6:
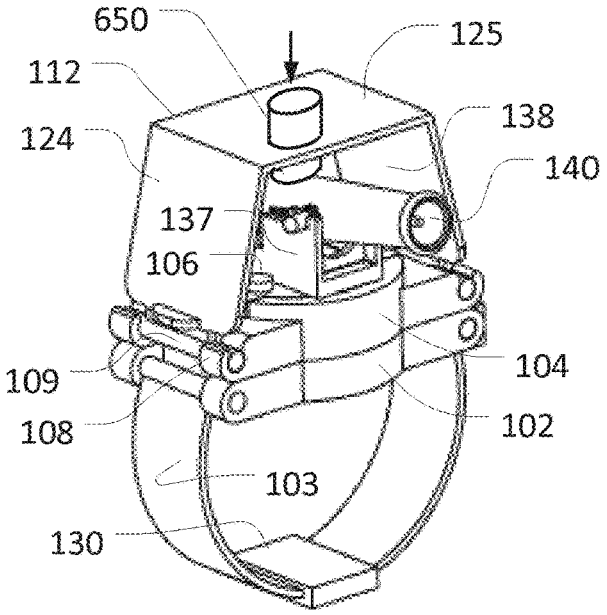
FIG. 6 illustrates another embodiment of a wearable toy system.

FIGS. 5A-B illustrate the mating mounting members of the mounting plate 102 and the toy receiving base 104. In particular, FIG. 5A shows a cross-sectional view of the mounting plate 102 and the toy-receiving base 104 attached to each other, e.g. as described in connection with FIGS. 3A-C above. FIG. 5B shows a cross sectional view of the mounting plate 102 with another toy construction element 513, e.g. a toy construction element of the type shown in FIGS. 8-10 below placed on top of the mounting plate. As can be seen from FIG. 5B, the toy construction element 513 comprises downwardly extending walls 519 that form coupling members for engaging coupling protrusions 506 of another toy construction element of the toy construction system. The walls prevent the toy construction element to be connected to the mounting element of the mounting plate, as the elevated portion 116 provides a barrier that prevents the toy construction element to be lowered over the elevated element such that a pin can be inserted into the hole 134.

FIG. 5 shows another embodiment of a wearable toy system. The toy of FIG. 5 is similar to the toy shown in FIG. 3A. However, in this example, the cover 112 comprises a push button 650 extending through the cover. The push button may e.g. be spring loaded. When a user presses the button as indicated by the arrow, the button moves towards the interior of the housing and can engage an actuator of the toy 137 positioned in the housing. It will be appreciated that the toy housing may comprise other types of actuator members, e.g. a lever. Similarly, the actuator member may be positioned at other positions of the cover or elsewhere on the housing.

FIG. 7 shows the housing 110 of the wearable toy system of FIGS. 1-3 detached from the mounting plate of the wearable component. As illustrated in FIG. 7, the housing 110 may be attached to a suitable mounting element 716, 734 of a toy construction element 714. In this example, the toy construction element 714 is a plate that can be attached to coupling members 706 of other toy construction elements of the toy construction system. The mounting element comprises an annular skirt 716 and a central hole 734 compatible with the mounting elements of the toy-receiving base 104 of the housing.

Various aspects and embodiments of wearable toy systems have been described with reference to toy construction elements in the form of toy construction elements having mating protrusions and cavities as coupling members. For example, FIG. 8 shows an example of a toy construction element with coupling studs on its top surface and a cavity extending into the brick from the bottom. The cavity has a central tube, and coupling studs on another brick can be received in the cavity in a frictional engagement as disclosed in U.S. Pat. No. 3,005,282. FIGS. 9 and 10 show other examples of such prior art construction elements. The coupling studs are arranged in a square planar grid, i.e. defining orthogonal directions along which sequences of coupling studs are arranged. The distance between neighbouring coupling studs is uniform and equal in both directions. This or similar arrangements of coupling members at coupling locations defining a regular planar grid allow the toy construction elements to be interconnected in a discrete number of positions and orientations relative two each other, in particular at right angles with respect to each other. The embodiments of wearable toy systems shown in the previous figures are configured to be used with this type of toy construction elements having coupling members in the form of cooperating studs and cavities. However, other types of coupling members may also be used in addition to or instead of the studs and cavities.

Although the invention has been described with reference to certain specific embodiments, various modifications thereof will be apparent to those skilled in art without departing from the spirit and scope of the invention as outlined in claims appended hereto.

The invention claimed is:

1. A wearable toy system comprising:

a wearable component;

a toy housing; and at least one replaceable toy;

wherein the wearable component comprises at least one fastening member for securing the wearable component to a part of a user's body;

wherein the toy housing comprises a toy-receiving base and a cover, the toy-receiving base being adapted to receive at least a base member of the replaceable toy, the toy-receiving base and the cover together defining a void for accommodating at least a part of the replaceable toy when the base member is received by the toy-receiving base and when the cover is in a closed state;

wherein the toy housing defines at least one opening when the cover is in the closed state, the opening allowing one or more parts of the replaceable toy to extend out of the toy housing;

wherein the toy-receiving base defines a support face facing away from the part of the user's body when the wearable component is worn by the user and wherein the cover comprises a transverse portion extending across at least a part of the support face at a distance from the support face; and wherein the opening is a lateral opening allowing one or more parts of the replaceable toy to extend out of the toy housing along a direction parallel to the support face.

2. The wearable toy system according to claim 1:

wherein the wearable component comprises a mounting member defining a mounting face facing away from the part of the user's body when the wearable component is worn by the user; and wherein the mounting member and the toy housing comprise respective mating mounting elements configured for removable attachment of the toy housing to the mounting face in rotatable engagement wherein the toy housing is rotatable around an axis of rotation projecting out of the mounting face.

3. The wearable toy system according to claim 2, wherein the toy housing and the mounting member comprise cooperating indexing elements allowing the toy housing to be rotated between a plurality of discrete orientations of the toy housing relative to the mounting member and to selectively retain the toy housing in one of said discrete orientations.

4. The wearable toy system according to claim 2, wherein the cover comprises two side portions extending away from the support face and a transverse portion extending between the side portions at a distance from the mounting face.

5. The wearable toy system according to claim 1, wherein the cover comprises at least one retaining member adapted to engage the replaceable toy when replaceable toy is received by the toy-receiving base and when the cover is in its closed state so as to retain the replaceable toy in engagement with the toy-receiving base.

6. The wearable toy system according to claim 1, wherein the base member and the toy-receiving base comprise respective indexing elements adapted to allow the base member to be received by the toy-receiving base only in one of a set of one or more discrete relative orientations of the base member relative to the toy-receiving base.

7. The wearable toy system according to claim 1, wherein the replaceable toy comprises a toy body and an ejectable component operable to be ejected by the toy body through the opening when the replaceable toy is positioned inside the toy housing.

8. The wearable toy system according to claim 1, further comprising a plurality of toy construction elements each having coupling members for detachably connecting the toy construction elements with other toy construction elements of the toy system; and wherein the base member defines a top face and a bottom side, opposite the top face and adapted to face the mounting face when the base member is received by the toy-receiving base, the top face comprising one or more coupling members adapted to interengage with corresponding mating coupling members of one or more of said toy construction elements.

9. A wearable toy system comprising:

a wearable component;

a toy housing; and at least one replaceable toy;

wherein the wearable component comprises at least one fastening member for securing the wearable component to a part of a user's body;

wherein the toy housing comprises a toy-receiving base and a cover, the toy-receiving base being adapted to receive at least a base member of the replaceable toy, the toy-receiving base and the cover together defining a void for accommodating at least a part of the replaceable toy when the base member is received by the toy-receiving base and when the cover is in a closed state;

wherein the toy housing defines at least one opening when the cover is in the closed state, the opening allowing one or more parts of the replaceable toy to extend out of the toy housing;

wherein the replaceable toy comprises a user-operable activator and is operable to perform a user-activatable function responsive to an activation of the user-operable activator; and wherein the user-operable activator extends out of the housing through the opening or is activatable through the opening.

10. The wearable toy system according to claim 9:

wherein the wearable component comprises a mounting member defining a mounting face facing away from the part of the user's body when the wearable component is worn by the user; and wherein the mounting member and the toy housing comprise respective mating mounting elements configured for removable attachment of the toy housing to the mounting face in rotatable engagement wherein the toy housing is rotatable around an axis of rotation projecting out of the mounting face.

11. The wearable toy system according to claim 10, wherein the toy housing and the mounting member comprise cooperating indexing elements allowing the toy housing to be rotated between a plurality of discrete orientations of the toy housing relative to the mounting member and to selectively retain the toy housing in one of said discrete orientations.

12. The wearable toy system according to claim 11, wherein the cover comprises two side portions extending away from a support face and a transverse portion extending between the side portions at a distance from the mounting face.

13. The wearable toy system according to claim 10, wherein the cover comprises at least one retaining member adapted to engage the replaceable toy when replaceable toy is received by the toy-receiving base and when the cover is in its closed state so as to retain the replaceable toy in engagement with the toy-receiving base.

14. The wearable toy system according to claim 10, wherein the base member and the toy-receiving base comprise respective indexing elements adapted to allow the base member to be received by the toy-receiving base only in one of a set of one or more discrete relative orientations of the base member relative to the toy-receiving base.

15. The wearable toy system according to claim 9, wherein the replaceable toy comprises a toy body and an ejectable component operable to be ejected by the toy body through the opening when the replaceable toy is positioned inside the toy housing.

16. The wearable toy system according to claim 9, further comprising a plurality of toy construction elements each having coupling members for detachably connecting the toy construction elements with other toy construction elements of the toy system; and wherein the base member defines a top face and a bottom side, opposite the top face and adapted to face the mounting face when the base member is received by the toy-receiving base, the top face comprising one or more coupling members adapted to interengage with corresponding mating coupling members of one or more of said toy construction elements.

17. A wearable toy system comprising:

a wearable component;

a plurality of toy construction elements; and at least one replaceable base member;

wherein the wearable component comprises a toy-receiving base and at least one fastening member for securing the wearable component to a part of a user's body;

wherein the toy-receiving base defines a support face facing away from the part of the user's body when the wearable component is worn by the user and the toy-receiving base being adapted to receive the base member;

wherein each of the toy construction elements comprises coupling members for detachably connecting the toy construction elements with other toy construction elements of the toy system;

wherein the base member defines a top side and a bottom side, opposite the top side and adapted to face the support face of the toy-receiving base when the base member is received by the toy-receiving base, wherein the top side comprises one or more coupling members adapted to inter-engage with corresponding mating coupling members of one or more of said toy construction elements; and wherein the base member and the toy-receiving base comprise respective indexing elements adapted to allow the base member to be received by the toy-receiving base only in one of a set of one or more discrete relative orientations of the base member relative to the toy-receiving base.

18. The wearable toy system according to claim 17:

wherein the coupling members are arranged in a two-dimensional grid, the two-dimensional grid defining a first and a second principle direction; and wherein at least one of the principle directions projects outward through said opening of the toy housing when the base member is received by the toy-receiving base.

19. The wearable toy system according to claim 17:

wherein the wearable component comprises a mounting member defining a mounting face facing away from the part of the user's body when the wearable component is worn by the user; and wherein the mounting member and the toy-receiving base comprise respective mating mounting elements configured for removable attachment of the toy-receiving base to the mounting face in rotatable engagement wherein the toy-receiving base is rotatable around an axis of rotation projecting out of the mounting face.

20. The wearable toy system according to claim 19, wherein the toy-receiving base and the mounting member comprise cooperating indexing elements allowing the toy-receiving base to be rotated between a plurality of discrete orientations of the toy-receiving base relative to the mounting member and to selectively retain the toy-receiving base in one of said discrete orientations.

* * * * *